US007051380B2

(12) United States Patent
Haaga

(10) Patent No.: US 7,051,380 B2
(45) Date of Patent: May 30, 2006

(54) SAFETY FILTRATION APPAREL

(75) Inventor: John R. Haaga, 4309 N. Hilltop, Chagrin Falls, OH (US) 44022

(73) Assignee: John R. Haaga, Chagrin Falls, OH (US)

( * ) Notice: Subject to any disclaimer, the term of this patent is extended or adjusted under 35 U.S.C. 154(b) by 39 days.

(21) Appl. No.: 10/287,237

(22) Filed: Nov. 4, 2002

(65) Prior Publication Data

US 2004/0055079 A1 Mar. 25, 2004

Related U.S. Application Data

(60) Provisional application No. 60/365,402, filed on Mar. 18, 2002, provisional application No. 60/347,922, filed on Nov. 7, 2001.

(51) Int. Cl.
*A41D 14/12* (2006.01)

(52) U.S. Cl. ..... 2/456; 2/901; 2/181; 2/84; 2/410; 128/201.25; 442/110

(58) Field of Classification Search ..... 2/456, 2/457, 410, 424, 15, 9, 84, 171.2, 173, 181, 2/181.4, 181.5, 202, 203, 206, 207, 901, 2/918; 128/201.25, 857; 442/110 T
See application file for complete search history.

(56) References Cited

U.S. PATENT DOCUMENTS 3,885,558 A * 5/1975 Belkin ..... 128/201.25
4,589,408 A * 5/1986 Singer ..... 128/857
4,870,959 A * 10/1989 Reisman et al. ..... 128/201.25
4,932,078 A * 6/1990 Jones et al. ..... 2/70
H0823 H 10/1990 Conkle et al.

(Continued)

OTHER PUBLICATIONS

U.S. Appl. No. 60/347,922; filed Nov. 7, 2001.

(Continued)

*Primary Examiner*—John J. Calvert
*Assistant Examiner*—Robert H. Muromoto
(74) *Attorney, Agent, or Firm*—Fay Sharpe Fagan Minnich & McKee; Brian E. Turung; Robert V. Vickers

(57) ABSTRACT

Safety apparel and/or non-apparel items that filter from the air one or more airborne particles and/or undesired gases to provide safety to a human and/or non-human from potentially unhealthy airborne particles. The apparel and/or non-apparel item at least partially includes a filter material. The filter material on the apparel and/or non-apparel item has a sufficient size to enable the human and/or non-human to cover the nose, eyes, and/or mouth of the human and/or non-human. The filter material filters at least one airborne particle and/or undesired gas by a mechanical mechanism, an electrical mechanism, and/or a chemical mechanism. The apparel and/or non-apparel item can include at least one visual and/or textural indicator on the apparel and/or non-apparel item to at least partially indicate the location of the filter material on the apparel and/or non-apparel item.

36 Claims, 2 Drawing Sheets

U.S. PATENT DOCUMENTS

| | | | | | |
|---|---|---|---|---|---|
| 4,969,457 | A | | 11/1990 | Hubbard | |
| 5,206,958 | A | * | 5/1993 | Widenback | 2/457 |
| 5,269,024 | A | * | 12/1993 | Wyatt | 2/173 |
| 5,452,712 | A | * | 9/1995 | Richardson | 128/201.25 |
| 5,588,153 | A | * | 12/1996 | Ignon et al. | 2/457 |
| 5,596,985 | A | | 1/1997 | Collier | |
| 5,682,606 | A | * | 11/1997 | Pospisil | 2/9 |
| 5,784,717 | A | * | 7/1998 | Singer | 2/79 |
| 5,830,810 | A | * | 11/1998 | Cohen | 442/110 |
| 5,937,445 | A | * | 8/1999 | Ravo et al. | 2/173 |
| 5,972,812 | A | | 10/1999 | Sakata et al. | |
| 2004/0055079 | A1 | | 3/2004 | Haaga | |

OTHER PUBLICATIONS

U.S. Appl. No. 60/365,402; filed Mar. 18, 2002.
3M Health CareFace Masks and Respirators—2004.
3M Health Care Particulate Respirator and Surgical Mask—Jul. 2003.
3M Filtrete.

* cited by examiner

SAFETY FILTRATION APPAREL

The present invention claims priority on co-pending U.S. patent application Ser. Nos. 60/347,922 filed Nov. 7, 2001 entitled "Safety Filtration Apparel" and 60/365,402 filed Mar. 18, 2002 entitled "Safety Filtration Apparel," both of which are incorporated herein by reference.

The present invention is related to safety fabrics, and more particularly to apparel and/or other types of fabrics that provide at least partial protection from airborne particles.

BACKGROUND OF THE INVENTION

In recent times, there has been some concern for public safety with respect to biological attacks on the public by terrorists or other criminal elements. The potential for biological attacks is believed to be primarily in the form of airborne particles and/or contamination of public water supplies.

With respect to airborne particles, the biological agent can be conveyed to individual households and/or to public locations by envelopes, packages and/or the like, which are transported by common mail carriers. In this conveyance mode, the biological agent is typically in powdered form and is dispersed into the air upon opening the envelopes, packages and/or the like. Alternatively, the biological agent can be released into the air by use of an aircraft, detonation of a bomb, by releasing the biological agent from atop a building or other type of structure, and/or the like. In each of these situations, the biological agent, typically in powdered form, but alternatively may be in aerosol and/or liquid form, is designed to infect a large number individuals exposed to the biological agent.

Areas of concern for contact with a biological agent include, but are not limited to, outdoor sporting events, outdoor fairs and circuses, large outdoor public gatherings, and the like. Most often, such biological terrorism has little or no warning. As such, the exposed or potentially exposed public has little ability to reduce or prevent exposure to biological agents that are released into the such public areas.

Safety masks are known for use by doctors and their staff to protect the doctor and his/her staff from adverse bacteria, viruses and the like. Painters masks are also known for use by painters to protect the painter from paint particles in the air during a painting process. Although these types of masks could be used by the public to provide at least some protection from an adverse biological agent, such masks are not commonly used by the public, especially in public areas. This lack of use by the public of such masks can be partially attributed to many people considering the wearing of such masks in public is socially and/or fashionably unacceptable. In addition, such masks are an extra accessory that must be packed before traveling to a public area. As such, many people forget to pack and/or purchase such masks when traveling to a public area, thus do not have such masks readily available during a time of need.

In view of the potential dangers of being exposed to adverse biological agents in public areas and/or other areas, there is a need for a protective device that is convenient and readily accessible for use by an individual to provide such individual with a degree of protection from an adverse biological agent.

SUMMARY OF THE INVENTION

The present invention is related to safety fabrics, and more particularly to apparel and/or other types of fabrics that provide at least partial protection from airborne particles and/or gasses. More particularly, the present invention is directed to apparel that is, in many instances, commonly used by individuals, which apparel includes a material that can filter out one or more potentially harmful airborne particles and/or gasses. Such apparel provides an individual with some protection from airborne biological agents until the individual has time to remove oneself from the potentially contaminated area and/or after the danger to infection from the biological agent has at least partially passed.

In accordance with the present invention, there is provided apparel that is made from, or includes one or more pieces of, filter fabric that can filter out one or more airborne particles and/or gasses. The filter fabric can be a woven and/or non-woven material. The filter fabric can be made from natural fibers (e.g. cotton, wool, etc.) and/or from synthetic fibers (e.g. polyester, nylon, etc.). The thickness of the filter fabric can be varied depending on the desired filter efficiencies and/or the region of the apparel where the filter fabric is to be used. The filter fabric can be designed to filter airborne particles and/or gasses by mechanical mechanisms (e.g. weave density), by electrical mechanisms (e.g. charged fibers, charged metals, etc.), and/or by chemical mechanisms (e.g. absorptive charcoal particles, adsorptive materials, etc.). In one embodiment of the invention, the filter material includes electrically charged fibers such as, but not limited to, FILTRETE by 3M. In another and/or alternative embodiment of the invention, the filter material includes a high density material similar to material used for medical masks which are used by medical personnel in doctors' offices, hospitals, and the like. Non-limiting examples of such masks are disclosed in U.S. Pat. Nos. 5,596,985; 4,969,457; and 4,589,408 and the United States patents cited and/or referenced therein, all of which are incorporated herein by reference. In yet another and/or alternative embodiment of the invention, the filter material includes two or more layers of filter material. The layers of filter material can be the same type of filter material or different types of filter material. In still another and/or alternative embodiment of the invention, the filter material is designed to filter a majority of particles having a particle size of at least about 20 microns. In one aspect of this embodiment, the filter material is designed to filter a majority of particles having a particle size of at least about 10 microns. In another and/or alternative aspect of this embodiment, the filter material is designed to filter a majority of particles having a particle size of at least about 5 microns. In still another and/or alternative aspect of this embodiment, the filter material is designed to filter a majority of particles having a particle size of at least about 2 microns. At the 2 micron level, most fungi, bacteria and/or viruses are filtered from the air. In yet another and/or alternative aspect of this embodiment, the filter material is designed to filter a majority of particles having a particle size of at least about 1 micron. In still yet another and/or alternative aspect of this embodiment, the filter material is designed to filter a majority of particles having a particle size of at least about 0.5 micron. The filter efficiencies of the filter material will depend on several factors such as, but not limited to, the level of filtration desired, the pressure drop through the filtration material (i.e. the ability of an individual to breathe through the filter material), the thickness of the filter material, the type of apparel, and/or the location of the filter material on the apparel.

In accordance another and/or alternative aspect of the present invention, there is provided non-apparel items that are made from, or include one or more pieces of, filter fabric that can filter out one or more airborne particles ad/or gasses.

The filter fabric can be a woven and/or non-woven material. The filter fabric can be made from natural fibers (e.g. cotton, wool, etc.) and/or from synthetic fibers (e.g. polyester, nylon, etc.). The thickness of the filter fabric can be varied depending on the desired filter efficiencies and/or the region of the non-apparel item where the filter fabric is to be used. The filter fabric can be designed to filter airborne particles and/or gasses by mechanical mechanisms (e.g. weave density), by electrical mechanisms (e.g. charged fibers, charged metals), etc.), and/or by chemical mechanisms (e.g. absorptive charcoal particles, adsorptive materials, etc.). In one embodiment of the invention, the filter material includes electrically charged fibers such as, but not limited to, FILTRETE by 3M. In another and/or alternative embodiment of the invention, the filter material includes a high density material similar to material used for medical masks which are used by medical personnel in doctors' offices, hospitals, and the like. Non-limiting examples of such masks are disclosed in U.S. Pat. Nos. 5,596,985; 4,969,457; and 4,589,408 and the United States patents cited and/or referenced therein, all of which are incorporated herein by reference. In yet another and/or alternative embodiment of the invention, the filter material includes two or more layers of filter material. The layers of filter material can be the same type of filter material or different types of filter material. In still another and/or alternative embodiment of the invention, the filter material is designed to filter a majority of particles having a particle size of at least about 20 microns. In one aspect of this embodiment, the filter material is designed to filter a majority of particles having a particle size of at least about 10 microns. In another and/or alternative aspect of this embodiment, the filter material is designed to filter a majority of particles having a particle size of at least about 5 microns. In still another and/or alternative aspect of this embodiment, the filter material is designed to filter a majority of particles having a particle size of at least about 2 microns. At the 2 micron level, most fungi, bacteria and/or viruses are filtered from the air. In yet another and/or alternative aspect of this embodiment, the filter material is designed to filter a majority of particles having a particle size of at least about 1 micron. In still yet another and/or alternative aspect of this embodiment, the filter material is designed to filter a majority of particles having a particle size of at least about 0.5 micron. The filter efficiencies of the filter material will depend on several factors such as, but not limited to, the level of filtration desired, the pressure drop through the filtration material (i.e. the ability of an individual to breathe through the filter material), the thickness of the filter material, the type of non-apparel item, and/or the location of the filter material on the non-apparel item.

In accordance with still another and/or alternative aspect of the present invention, the apparel which includes the filter material is clothing that can be at least partially conveniently and/or easily placed over one's mouth, eyes, and/or nose during a potential and/or actual biological incident. Such apparel allows for more convenient and rapid protection during the potential and/or actual biological incident. During a potential and/or actual biological incident, the individual cups or otherwise places the filter material over one's mouth, eyes, and/or nose and then uses the filter material until the incident has passed and/or the individual has removed oneself from the area of incident. In one embodiment of the invention, the apparel includes, but is not limited to, shirts, blouses, vests, sweaters, undergarments, sweatshirts, jackets, coats, scarves, head bands, ear muffs, ear and/or neck warmers, handkerchiefs, hats, caps, gloves, neckties, ski masks, mufflers, dresses, socks, pants, purses, billfolds, diapers, underwear, bras, and the like. These types of apparel can be easily or relatively easily placed over an individual's nose, eyes, and/or mouth during an actual or potential biological incident. The apparel can be continuously used by the individual until the incident has passed and/or the individual has removed oneself from the site of the actual or potential biological incident. In another and/or alternative embodiment of the invention, the placement and/or size of the filter material in the apparel is sufficient to allow an individual to cover one's mouth, eyes, and/or nose. In one aspect of this embodiment, the placement and/or size of the filter material on the apparel is sufficient to allow an individual to cover one's mouth, eyes and nose. In another and/or alternative aspect of this embodiment, the placement and/or size of the filter material on the apparel is sufficient to allow an individual to cover one's mouth and nose. In still another and/or alternative aspect of this embodiment, the placement and/or size of the filter material on the apparel is sufficient to allow an individual to cover one's eyes and nose. In yet another and/or alternative aspect of this embodiment, the placement and/or size of the filter material on the apparel is sufficient to allow an individual to cover one's eyes and mouth. In still yet another and/or alternative aspect of this embodiment, the placement and/or size of the filter material on the apparel is sufficient to allow an individual to cover one's eyes. In a further and/or alternative aspect of this embodiment, the placement and/or size of the filter material on the apparel is sufficient to allow an individual to cover one's mouth. In still a further and/or alternative aspect of this embodiment, the placement and/or size of the filter material on the apparel is sufficient to allow an individual to cover one's nose. In still another and/or alternative embodiment of the invention, the apparel can include one or more visual and/or textural indicators to enable an individual to locate the filter material on the apparel. In one aspect of this embodiment, the filter material on the apparel is a different color from at least a portion of other fabric on the apparel that is at least closely adjacent to the filter material. In another and/or alternative aspect of this embodiment, the filter material on the apparel has a different weave and/or thickness from at least a portion of other fabric on the apparel that is at least closely adjacent to the filter material. In still another and/or alternative aspect of this embodiment, the apparel includes one or more markings that at least partially identify the location of the filter material. In yet another and/or alternative aspect of this embodiment, the filter material on the apparel has a different texture from at least a portion of other fabric on the apparel that is at least closely adjacent to the filter material.

In accordance with yet another and/or alternative aspect of the present invention, the non-apparel item which includes the filter material can be at least partially conveniently and/or easily placed over one's mouth, eyes, and/or nose during a potential and/or actual biological incident. Such non-apparel item allows for more convenient and rapid protection during the potential and/or actual biological incident. During a potential and/or actual biological incident, the individual cups or otherwise places the filter material over one's mouth, eyes, and/or nose and then uses the filter material until the incident has passed and/or the individual has removed oneself from the area of incident. In one embodiment of the invention, the non-apparel item includes, but is not limited to, blankets, throws, quilts, sheets, pillow cases, bed skirts, mattress pads, mattress covers, pillows, towels, wash cloths, curtains, blinds, window shades, rugs, cloths, placemats, napkins, table cloths, coasters, rags, sponges, hot pads, valances, drapes, armchair covers, and the like. These types of non-apparel items can be easily or relatively easily placed over an individual's nose, eyes, and/or mouth during an actual or potential biological incident. The non-apparel item can be continuously used by the individual until the incident has passed and/or the individual has removed oneself from the site of the actual or potential biological incident. In another and/or alternative embodiment of the invention, the placement and/or size of the filter material in the non-apparel item is sufficient to allow an individual to cover one's mouth, eyes and nose. In another and/or alternative aspect of this embodiment, the placement and/or size of the filter material on the non-apparel item is sufficient to allow an individual to cover one's mouth and nose. In still another and/or alternative aspect of this embodiment, the placement and/or size of the filter material on the non-apparel item is sufficient to allow an individual to cover one's eyes and nose. In yet another and/or alternative aspect of this embodiment, the placement and/or size of the filter material on the non-apparel item is sufficient to allow an individual to cover one's eyes and mouth. In still yet another and/or alternative aspect of this embodiment, the placement and/or size of the filter material on the non-apparel item is sufficient to allow an individual to cover one's eyes. In a further and/or alternative aspect of this embodiment, the placement and/or size of the filter material on the non-apparel item is sufficient to allow an individual to cover one's mouth. In still a further and/or alternative aspect of this embodiment, the placement and/or size of the filter material on the non-apparel item is sufficient to allow an individual to cover one's nose. In still another and/or alternative embodiment of the invention, the non-apparel item can include one or more visual and/or textural indicators to enable an individual to locate the filter material on the non-apparel item. In one aspect of this embodiment, the filter material on the non-apparel item is a different color from at least a portion of other fabric on the non-apparel item that is at least closely adjacent to the filter material. In another and/or alternative aspect of this embodiment, the filter material on the non-apparel item has a different weave and/or thickness from at least a portion of other fabric on the non-apparel item that is at least closely adjacent to the filter material. In still another and/or alternative aspect of this embodiment, the non-apparel item includes one or more markings that at least partially identify the location of the filter material. In yet another and/or alternative aspect of this embodiment, the filter material on the non-apparel item has a different texture from at least a portion of other fabric on the non-apparel item that is at least closely adjacent to the filter material.

In accordance with still yet another and/or alternative aspect of the present invention, the apparel and/or non-apparel item which includes the filter material can be used to at least partially protect and/or shield an individual from undesired environmental conditions other than a potential and/or an actual biological incident. Such undesired environmental conditions include, but are not limited to, air pollutants (e.g., smoke, chemical emissions, etc.), dust, pollen, insects, spores, vehicle emissions, factory emissions, bacteria, viruses, and/or other undesirable particles and/or gasses in the air. As a result, the apparel allows for convenient and rapid protection from undesired environmental conditions. In one example, an individual could cover one's nose, eyes, and/or mouth when exposed to unacceptable dust and/or dirty environments. In another and/or alternative example, an individual could cover one's nose, eyes, and/or mouth when in close proximity to sick individuals (e.g., hospital environment, doctor's office, visiting sick individuals, caring for sick individuals, etc.). In still another and/or alternative example, an individual could cover one's nose, eyes, and/or mouth when exposed to allergens (e.g., pollen, spores, etc.). In still another and/or alternative example, an individual could cover one's nose, eyes, and/or mouth when exposed to environments having unacceptable amounts of insects (e.g., forests, swamps, parks, farms, zoos, ponds, lakes, oceans, rivers, etc.). Indeed, when in any environment that is deemed unsafe and/or unacceptable to an individual, the individual can cover his or her nose, eyes, and/or mouth. When in such environment, the individual cups or otherwise places the filter material over one's mouth, eyes, and/or nose and then breathes through the filter material until the individual leaves such environments and/or deems the environment acceptable.

In accordance with a further and/or alternative aspect of the present invention, the apparel and/or non-apparel item can include a filter material that fully or partially filters undesired gasses (e.g., tear gas, odors, toxic gasses, noxious gasses, etc.) from the air. The filter material is designed to at least partially remove gasses from the air such as, but not limited to, smoke, fumes, gas contaminants, and/or noxious gases. In one embodiment, the filter material incorporates the use of one or more gas absorbing and/or adsorbing substances to absorb and/or adsorb gasses that are drawn into the filter material (e.g. carbon, etc.). The filter material that filters undesired gasses from the air can also function as the particle filter and/or be a separate filter material.

In accordance with a still further and/or alternative aspect of the present invention, the filter material in the apparel and/or non-apparel item is removable. After an individual has passed and/or been exposed to an undesired environment, the individual may want to dispose of the filter material and replace the filter material with new filter material. Alternatively or additionally, an individual may want to clean the apparel or non-apparel item after the individual has passed and/or been exposed to an undesired environment, and therefore may want to remove the filter material so that the filter material will not be damaged when the apparel or non-apparel item is cleaned. In one embodiment, the filter material is detachably connected to the apparel or non-apparel item by a mechanism such as, but not limited to, Velcro, snaps, zippers, buttons, hooks, tongue and groove connectors, laces, cords, belts, etc.

In accordance with a yet further and/or alternative aspect of the present invention, the filter material in the apparel and/or non-apparel item is washing machine safe. As a result, the filter material can be cleaned with the apparel and/or non-apparel item without having to remove the filter material from the apparel and/or non-apparel item, or damaging the filter material when cleaning the apparel and/or non-apparel item.

In accordance with a yet further and/or alternative aspect of the present invention, the apparel and/or non-apparel item that includes the filter material can be used to protect animals such as, but not limited to, pets and/or other valuable animals to an individual.

The principal object of the present invention is the provision of a fabric that provides at least partial protection from airborne particles and/or gasses.

Another and/or alternative object of the present invention is the provision of a protective fabric that can be at least partially conveniently and/or easily used by an individual to provide at least partial protection from airborne particles and/or gasses.

Still another and/or alternative object of the present invention is the provision of a protective fabric that is at least partially used in apparel to provide at least partial protection from airborne particles and/or gasses.

Yet another and/or alternative object of the present invention is the provision of a protective fabric that is at least partially used in non-apparel items to provide at least partial protection from airborne particles and/or gasses.

Still yet another and/or alternative object of the present invention is the provision of a protective fabric that is at least partially used to provide at least partial protection to one's nose, mouth and/or eyes from airborne particles and/or gasses.

A further and/or alternative object of the present invention is the provision of an apparel and/or non-apparel item that includes one or more visual indicators for the protective fabric on the apparel and/or non-apparel item.

Still a further and/or alternative object of the present invention is the provision of an apparel and/or non-apparel item that includes one or more textural indicators for the protective fabric on the apparel and/or non-apparel item.

Yet a further and/or alternative object of the present invention is the provision of an apparel and/or non-apparel item that includes a protective fabric that can be easily and/or conveniently removed and/or replaced on or from the apparel and/or non-apparel item.

Still yet a further and/or alternative object of the present invention is the provision of an apparel and/or non-apparel item that includes a protective fabric that can be easily and/or conveniently cleaned.

These and other objects and advantages will become apparent from the discussion of the distinction between the invention and the prior art and when considering the preferred embodiment as shown in the accompanying drawings.

PREFERRED EMBODIMENTS OF THE INVENTION

Figure 1:
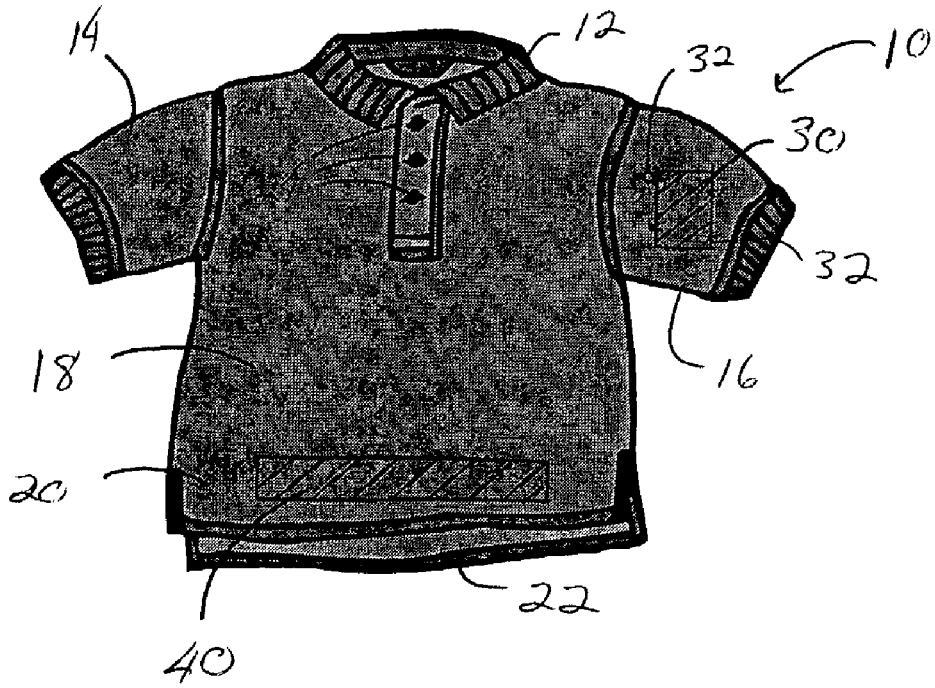
FIG. 1 is a pictorial view of a shirt that includes a protective material on the shirt sleeve and the base of the shirt in accordance with the present invention.

Referring now to the drawings wherein the showings are for the purpose of illustrating the preferred embodiments only and not for the purpose of limiting same, FIG. 1 shows a short sleeve shirt 10. The short sleeve shirt can be designed for a man, woman or child. Shirt 10 includes a collar 12, two sleeves 14, 16, a front 18, a front shirt tail 20, a back shirt tail 22, and buttons 24. Positioned in sleeve 16 is a protective material 30. A protective material 40 is illustrated as being positioned on front shirt tail 20 of the shirt. Protective materials 30 and 40 can be made of the same material or different materials. In addition, protective materials 30 and 40 can be have the same or different color. Furthermore, protective materials 30 and 40 can be have the same or different texture. Typically the protective material has a different texture from the other material of the shirt; however, this is not required. The different texture enables a wearer to quickly identify the location of the protective material and use such protective material when desired. The protective material may also have a different color from one or more other portions of the shirt to thereby provide a visual indicator of the location of the protective material; however, this is not required. Typically, the protective material is positioned on and/or incorporated in the shirt such that it blends with the color and/or design of the shirt so as to make the shirt aesthetically desirable to the wearer. As illustrated in FIG. 1, protective material 30, 40 is positioned on shirt 10 in different locations and has a different shape. The protective material typically is selected to filter out at least a majority of particles having a particle size of at least about 2 microns.

Protective material 30 is secured to sleeve 16 by stitching 32. Protective material 40 is releasably connected to front shirttail 20 by hook and loop connectors. The protective material can be stitched or otherwise firmly attached to the shirt, or be releasably connected to the shirt. When the protective material is firmly attached to the shirt, the protective material is typically at least partially formed of a wash resistant material so as to allow the shirt to be washed without substantially damaging the protective material. As can be appreciated, the protective material can be made of a wash resistant material even when the protective material is releasably connected to the shirt. When the protective material is releasably connected to the shirt, the protective material is typically connected to the shirt by a hook and loop arrangement (e.g. Velcro), a zipper, snaps and the like. The releasably connected feature of the protective material enables new protective material to be attached to the shirt.

The protective material on shirt 10 can be used by the user in several ways. Protective material 30 on sleeve 16 can be used by the user merely by the user moving his or her head into the shirt sleeve until the eyes, nose and/or mouth are protected by the protective material. Protective material 40 on front shirttail 20 can be used by the user lifting the shirttail until protective material 40 is positioned over and protects the eyes, nose and/or mouth of the user. Alternatively, protective material 40 can be detached from the front shirttail and moved over the eyes, nose and/or mouth of the user. Consequently, the incorporation of protective material on the shirt of a user provides the user with convenient and quick protection from undesirable particles and/or gasses in the air.

Figure 2:
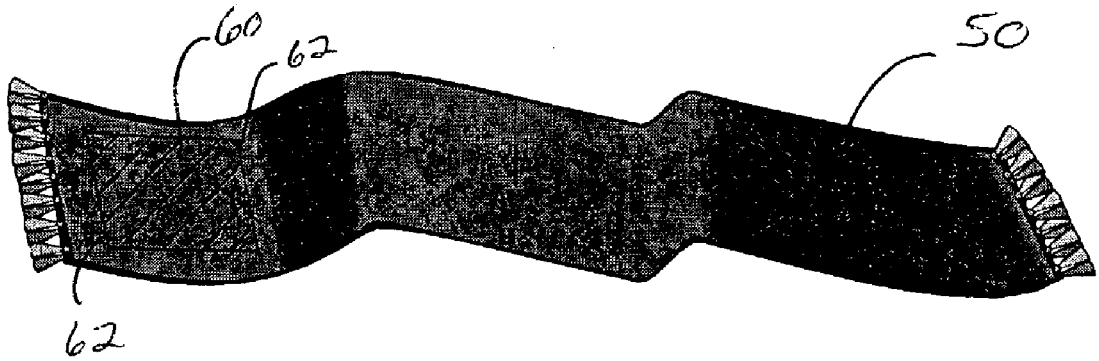
FIG. 2 is a pictorial view of a scarf that includes a protective material in accordance with the present invention.

Referring now to FIG. 2, there is illustrated a scarf 50 that includes a protective material 60 at one end of the scarf. As can be appreciated, the protective material can be positioned in other regions of the scarf. Protective material 60 is illustrated as being connected to the scarf by stitching 62; however, the protective material can be connected in other manners and/or can be releasably connected to the scarf. The protective material typically has a different texture from the other material of the scarf to enable the user to quickly and conveniently locate the protective material on the scarf. As can be appreciated, the protective material does not have to have a different texture from the other material of the scarf. The protective material on the scarf may have the same or different color from the other material on the scarf. If the color is different, the different color can be used as a visual indicator for the location of the protective material on the scarf. The protective material is typically wash resistant. The protective material typically is selected to filter out at least a majority of particles having a particle size of at least about 2 microns. The protective material on scarf 50 can be used by the user merely by the user moving the protective material on the scarf over the eyes, nose and/or mouth of the user. Consequently, the incorporation of protective material on the scarf of a user provides the user with convenient and quick protection from undesirable particles and/or gasses in the air.

Figure 3:
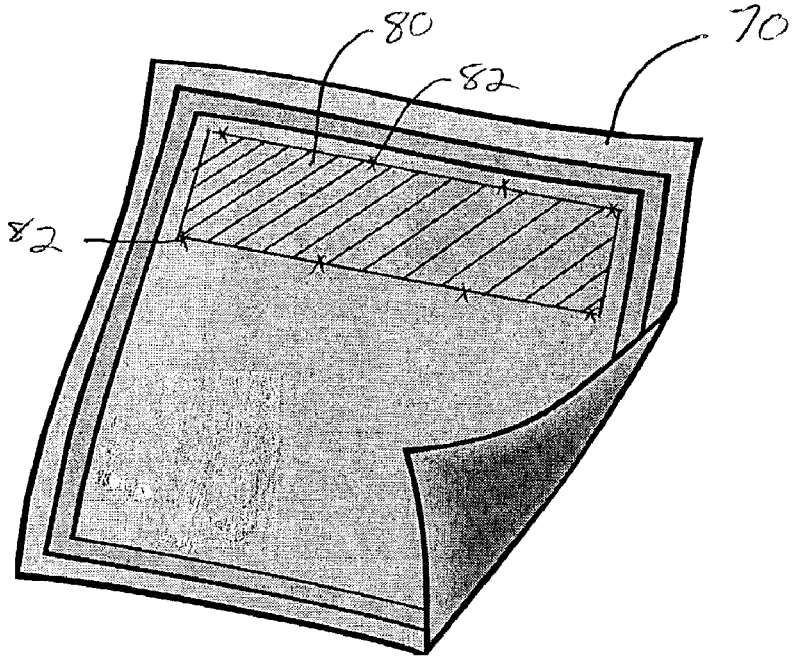
FIG. 3 is a pictorial view of a handkerchief that includes a protective material in accordance with the present invention; and, FIG. 4 is a pictorial view of a pillow that includes a protective material in accordance with the present invention.

Referring now to FIG. 3, there is illustrated a handkerchief 70 that includes a protective material 80 on a portion of the handkerchief. As can be appreciated, the protective material can be positioned in other regions of the handkerchief. Protective material 80 is illustrated as being connected to the handkerchief by stitching 82; however, the protective material can be connected in other manners and/or can be releasably connected to the handkerchief. The protective material typically has a different texture from the other material of the handkerchief to enable the user to quickly and conveniently locate the protective material on the handkerchief. As can be appreciated, the protective material does not have to have a different texture from the other material of the handkerchief. The protective material on the handkerchief may have the same or different color from the other material on the handkerchief. If the color is different, the different color can be used as a visual indicator for the location of the protective material on the handkerchief. The protective material is typically wash resistant. The protective material typically is selected to filter out at least a majority of particles having a particle size of at least about 2 microns. The protective material on handkerchief 70 can be used by the user merely by the user moving the protective material on the handkerchief over the eyes, nose and/or mouth of the user. Consequently, the incorporation of protective material on the handkerchief of a user provides the user with convenient and quick protection from undesirable particles and/or gasses in the air.

Figure 4:
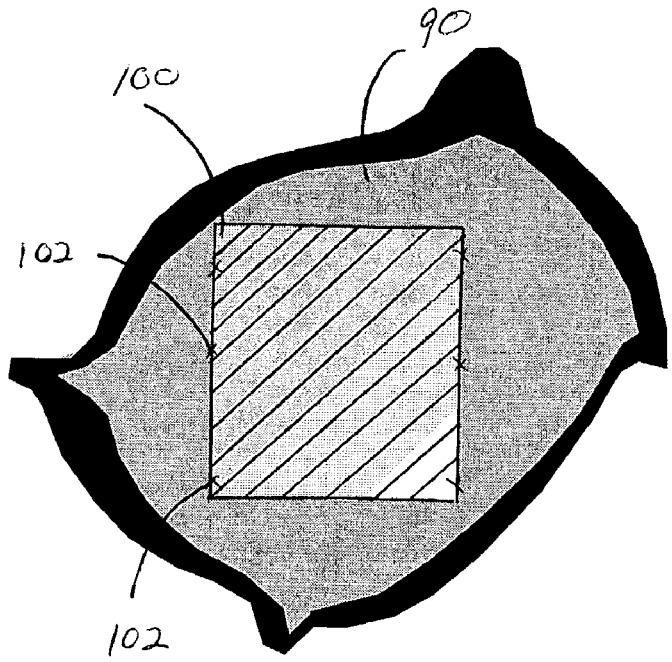

Referring now to FIG. 4, there is illustrated a pillow case 90 that includes a protective material 100 on a portion of the pillow case. As can be appreciated, the protective material can be positioned in other regions of the pillow case. Protective material 100 is illustrated as being connected to the pillow case by stitching 102; however, the protective material can be connected in other manners and/or can be releasably connected to the pillow case. The protective material typically has a different texture from the other material of the pillow case to enable the user to quickly and conveniently locate the protective material on the pillow case. As can be appreciated, the protective material does not have to have a different texture from the other material of the pillow case. The protective material on the pillow case may have the same or different color from the other material on the pillow case. If the color is different, the different color can be used as a visual indicator for the location of the protective material on the pillow case. The protective material is typically wash resistant. The protective material typically is selected to filter out at least a majority of particles having a particle size of at least about 2 microns. The protective material on pillow case 90 can be used by the user merely by the user moving the protective material on the pillow case over the eyes, nose and/or mouth of the user. Consequently, the incorporation of protective material on the pillow case of a user provides the user with convenient and quick protection from undesirable particles and/or gasses in the air, especially while in bed.

The present invention has been described with reference to a number of different embodiments. It is to be understood that the invention is not limited to the exact details of construction, operation, exact materials, or embodiments shown and described, as obvious modifications and equivalents will be apparent to one skilled in the art. It is believed that many modifications and alterations to the embodiments disclosed will readily suggest themselves to those skilled in the art upon reading and understanding the detailed description of the invention. It is intended to include all such modifications and alterations insofar as they come within the scope of the present invention.

I claim:

1. Apparel which can be used in an emergency or perceived emergency situation to at least partially filter airborne particles, gasses, or combinations thereof to provide at least some level of safety to a human from exposure to potentially unhealthy airborne particles, undesirable airborne particles, potentially unhealthy airborne gasses, undesirable airborne gasses, or combinations thereof, said apparel including a filter material and a majority of a non-filter fabric, said filter material secured to said non-filter fabric by stitching, hook and loop fastener, snaps, zippers, buttons, hooks, laces, cords, belts, or combinations thereof, said filter material being able to filter a majority of particles having a particle size of at least about 10 microns, said filter material positioned on said apparel so as to not fully cover a nose and mouth of the human, said apparel selected from the group consisting of shirts, blouses, vests, sweaters, undergarments, sweatshirts, jackets, coats, scarves, head bands, ear muffs, ear warmers, neck warmers, handkerchiefs, hats, caps, gloves, neckties, ski masks, mufflers, dresses, socks, pants, purses or billfolds, said filter material having a size to enable the human to reposition a portion of the apparel so as to enable the human to cover a nose and mouth of the human, to cover the eyes of the human, or combinations thereof with said filter material.

2. The apparel as defined in claim 1, wherein apparel is selected from the group consisting of scarves, head bands, neck warmers, handkerchiefs, neckties or ski masks.

3. The apparel as defined in claim 1, said filter material being able to filter a majority of particles having a particle size of at least about 2 microns.

4. The apparel as defined in claim 2, said filter material being able to filter a majority of particles having a particle size of at least about 2 microns.

5. The apparel as defined in claim 1, wherein said filter material filters at least one airborne particle by a mechanism selected from the group consisting of a mechanical mechanism, an electrical mechanism, a chemical mechanism, and combinations thereof.

6. The apparel as defined in claim 4, wherein said filter material filters at least one airborne particle by a mechanism selected from the group consisting of a mechanical mechanism, an electrical mechanism, a chemical mechanism, and combinations thereof.

7. The apparel as defined in claim 1, including at least one visual indicator, textural indicator, or combinations thereof on said apparel to at least partially indicate the location of said filter material on said apparel.

8. The apparel as defined in claim 6, including at least one visual indicator, textural indicator, or combinations thereof on said apparel to at least partially indicate the location of said filter material on said apparel.

9. The apparel as defined in claim 1, wherein said filter material at least partially filters potentially unhealthy airborne gasses, undesirable airborne gasses, or combinations thereof.

10. The apparel as defined in claim 8, wherein said filter material at least partially filters potentially unhealthy airborne gasses, undesirable airborne gasses, or combinations thereof.

11. The apparel as defined in claim 1, wherein said filter material is detachably connected to said apparel.

12. The apparel as defined in claim 10, wherein said filter material is detachably connected to said apparel.

13. Non-apparel which can be used in an emergency or perceived emergency situation to at least partially filter airborne particles, gasses; or combinations thereof to provide at least some level of safety to a human from exposure to potentially unhealthy airborne particles, undesirable airborne particles, potentially unhealthy airborne gasses, undesirable airborne gasses, or combinations thereof, said non-apparel including a filter material and a majority of a non-filter fabric, said filter material secured to said non-filter fabric by stitching, hook and loop fastener, snaps, zippers, buttons, hooks, laces, cords, belts, or combinations thereof, said filter material being able to filter a majority of particles having a particle size of at least about 10 microns, said filter material positioned on said non-apparel so as to not fully cover a nose and mouth of the human, said non-apparel selected from the group consisting of blankets, throws, quilts, sheets, pillow cases, bed skirts, mattress pads, mattress covers, pillows, towels, wash cloths, curtains, blinds, window shades, rugs, cloths, place mats, napkins, table cloths, coasters, rags, sponges, hot pads, valances, drapes, or armchair covers, said filter material having a size to enable the human to reposition a portion of the non-apparel so as to enable the human to cover a nose and mouth of the human, to cover the eyes of the human, or combinations thereof with said filter material.

14. The non-apparel as defined in claim 13, wherein said filter material is able to filter a majority of particles having a particle size of at least about 2 microns.

15. The non-apparel as defined in claim 13, wherein said filter material filters at least one airborne particle by a mechanism selected from the group consisting of a mechanical mechanism, an electrical mechanism, a chemical mechanism, and combinations thereof.

16. The non-apparel as defined in claim 14, wherein said filter material filters at least one airborne particle by a mechanism selected from the group consisting of a mechanical mechanism, an electrical mechanism, a chemical mechanism, and combinations thereof.

17. The non-apparel as defined in claim 13, including at least one visual indicator, textural indicator, or combinations thereof on said apparel to at least partially indicate the location of said filter material on said non-apparel.

18. The non-apparel as defined in claim 16, including at least one visual indicator, textural indicator, or combinations thereof on said apparel to at least partially indicate the location of said filter material on said non-apparel.

19. The non-apparel as defined in claim 13, wherein said filter material at least partially filters potentially unhealthy airborne gasses, undesirable airborne gasses, or combinations thereof.

20. The non-apparel as defined in claim 18, wherein said filter material at least partially filters potentially unhealthy airborne gasses, undesirable airborne gasses, or combinations thereof.

21. The non-apparel as defined in claim 13, wherein said filter material is detachably connected to said non-apparel.

22. The non-apparel as defined in claim 20, wherein said filter material is detachably connected to said non-apparel.

23. Apparel which can be used in an emergency or perceived emergency situation to at least partially filter airborne particles, gasses, or combinations thereof to provide at least some level of safety to a human from exposure to potentially unhealthy airborne particles, undesirable airborne particles, potentially unhealthy airborne gasses, undesirable airborne gasses, or combinations thereof, said apparel including a filter material and a majority of a non-filter fabric, said filter material secured to said non-filter fabric by stitching, hook and loop fastener, snaps, zippers, buttons, hooks, laces, cords, belts, or combinations thereof, said filter material being able to filter a majority of particles having a particle size of at least about 10 microns, said filter material at least partially filtering potentially unhealthy airborne gasses, undesirable airborne gasses, or combinations thereof, said apparel selected from the group consisting of shirts, blouses, vests, sweaters, undergarments, sweatshirts, jackets, coats, scarves, head bands, ear muffs, ear warmers, neck warmers, handkerchiefs, hats, caps, gloves, neckties, ski masks, mufflers, dresses, socks, pants, purses or billfolds, said filter material positioned on said apparel so as to not fully cover a nose and mouth of the human, to cover the eyes of the human, or combinations thereof with said filter material when the apparel is properly being worn, said filter material having a size and located on said apparel to enable the human to reposition a portion of the apparel including said filter material so as to enable the human to cover a nose and mouth of the human, to cover the eyes of the human, or combinations thereof with said filter material when said apparel is repositioned by the human.

24. The apparel as defined in claim 23, wherein said apparel is selected from the group consisting of a scarf, a head band, a neck warmer, a handkerchief, or a necktie.

25. The apparel as defined in claim 23, wherein said filter material is able to filter a majority of particles having a particle size of at least about 2 microns.

26. The apparel as defined in claim 24, wherein said filter material is able to filter a majority of particles having a particle size of at least about 2 microns.

27. The apparel as defined in claim 23, wherein said filter material filters at least one airborne particle by a mechanism selected from the group consisting of a mechanical mechanism, an electrical mechanism, a chemical mechanism, and combinations thereof.

28. The apparel as defined in claim 26, wherein said filter material filters at least one airborne particle by a mechanism selected from the group consisting of a mechanical mechanism, an electrical mechanism, a chemical mechanism, and combinations thereof.

29. The apparel as defined in claim 23, including at least one visual indicator, textural indicator, or combinations thereof on said apparel to at least partially indicate the location of said filter material on said apparel.

30. The apparel as defined in claim 26, including at least one visual indicator, textural indicator, or combinations thereof on said apparel to at least partially indicate the location of said filter material on said apparel.

31. The apparel as defined in claim 23, wherein said filter material is detachably connected to said apparel.

32. The apparel as defined in claim 30, wherein said filter material is detachably connected to said apparel.

33. Apparel which can be used in an emergency or perceived emergency situation to at least partially filter airborne particles, gasses, or combinations thereof to provide at least some level of safety to a human from exposure to potentially unhealthy airborne particles, undesirable airborne particles, potentially unhealthy airborne gasses, undesirable airborne gasses, or combinations thereof, said apparel including a filter material and a majority of a non-filter fabric, said filter material secured to said non-filter fabric by stitching, hook and loop fastener, snaps, zippers, buttons, hooks, laces, cords, belts, or combinations thereof, said filter material being able to filter a majority of particles having a particle size of at least about 2 microns, said filter material at least partially filtering potentially unhealthy airborne gasses, undesirable airborne gasses, or combinations thereof, said filter material filtering at least one airborne particle by a mechanism selected from the group consisting of a mechanical mechanism, an electrical mechanism, a chemical mechanism, and combinations thereof, said apparel selected from the group consisting of shirts, blouses, scarves, head bands, neck warmers, handkerchiefs, or neckties, said filter material positioned on said apparel so as to not fully cover a nose and mouth of the human, to cover the eyes of the human, or combinations thereof with said filter material when the apparel is properly being worn, said filter material having a size and located on said apparel to enable the human to reposition a portion of the apparel including said filter material so as to enable the human to cover a nose and mouth of the human, to cover the eyes of the human, or combinations thereof with said filter material when said apparel is repositioned by the human.

34. The apparel as defined in claim 33, including at least one visual indicator, textural indicator, or combinations thereof on said apparel, to at least partially indicate the location of said filter material on said apparel.

35. The apparel as defined in claim 33, wherein said filter material is detachably connected to said apparel.

36. The apparel as defined in claim 33, wherein said filter material is detachably connected to said apparel.

* * * * *